United States Patent [19]

Ciaffone

[11] 4,319,399

[45] Mar. 16, 1982

[54] STRAIGHT EDGE RAZOR

[75] Inventor: John T. Ciaffone, Bridgeport, Conn.

[73] Assignee: Warner-Lambert Company, Morris Plains, N.J.

[21] Appl. No.: 230,832

[22] Filed: Feb. 2, 1981

[51] Int. Cl.[3] ..... B26B 21/02

[52] U.S. Cl. ..... 30/32; 30/30; 30/63

[58] Field of Search ..... 30/32, 61, 62, 63, 320, 30/30

[56] References Cited

U.S. PATENT DOCUMENTS

| | | | |
|---|---|---|---|
| 978,230 | 12/1910 | Smith | 30/63 X |
| 1,337,429 | 4/1920 | Bergendahl | 30/30 |
| 1,748,376 | 2/1930 | Anderson | 30/320 X |
| 2,972,187 | 2/1961 | Gore | 30/30 |
| 3,675,323 | 7/1972 | Braginetz | 30/32 |

*Primary Examiner*—Jimmy C. Peters

*Attorney, Agent, or Firm*—R. S. Strickler

[57] ABSTRACT

A straight edge or barber razor having a blade operating lever useful to move the blade from an exposed or operating position to a closed or safe position.

1 Claim, 7 Drawing Figures

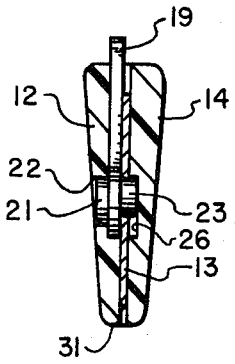
FIG.3
FIG.4
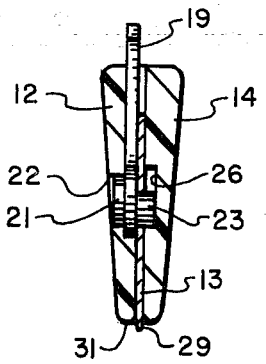
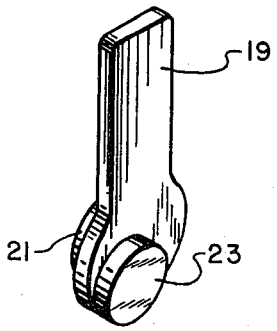
FIG.5

FIG.6
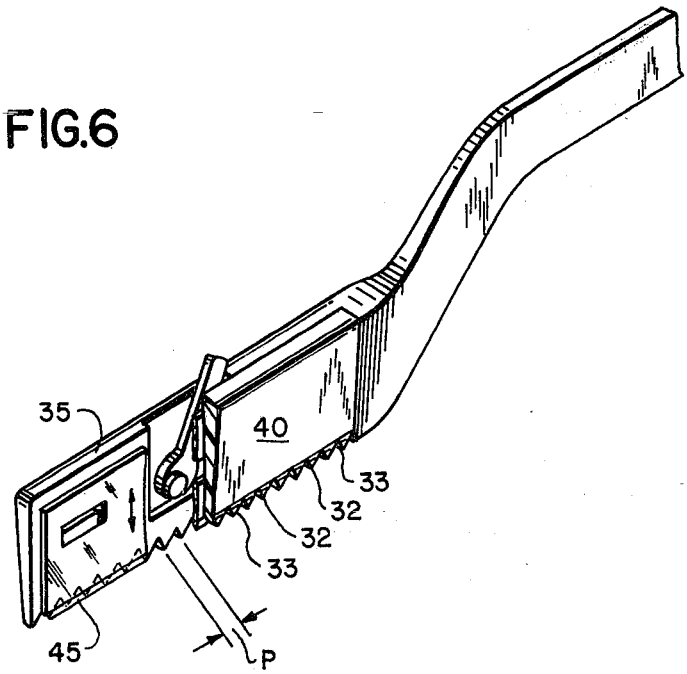
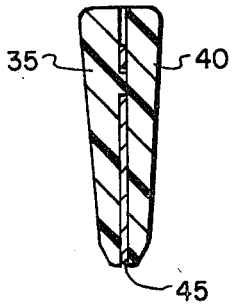
FIG. 7

STRAIGHT EDGE RAZOR

BACKGROUND OF THE INVENTION

1. Field of Invention

The present invention relates to straight edge razors frequently referred to as barber razors. Representative razors of the class to which the present invention pertains and over which the present invention is an improvement are illustrated in U.S. Pat. No. 3,772,778 and in U.S. Pat. No. 2,601,523.

2. Prior Art

The most pertinent prior art reference of which I am presently aware is the disclosure of Japanese Patent Laid Open No. 113489/1980, Sept. 2, 1980, bearing application Ser. No. 7852/1980.

This disclosure illustrates a straight razor sandwiched between toothed, notched or serrated blade guards where the teeth or notches have uniform configuration including uniform pitch distance. The cutting edge is positioned flush with or slightly below the apex of each tooth so that gaps or valleys between teeth are effective to expose the cutting edge for operation.

The principal feature of this Japanese disclosure is that one blade guard is fixed in an advanced or shifted position relative to the other fixed guard by an amount equal to one-half of the tooth pitch distance apparently reducing the cutting edge exposure that would be the case if the teeth of both guards were in phase or in registration.

SUMMARY OF THE INVENTION

It is a principal feature of the present invention to provide a razor of the class described which is equipped with a blade operating lever means useful to move the blade relative to side bars or side guides from a first position defining a normal or operative position to a second position defining a closed, inoperative or safe position.

A representative embodiment of the invention and embracing the principal features thereof may comprise a handle element, said handle element terminating in a blade guide, a second blade guide, a blade having a cutting edge sandwiched between said guides, an operating lever means mounted in one guide, said lever being formed with opposed eccentrically disposed projections, a first projection being recessed in said one guide and serving as a pivot for said lever, a second projection being received in a mating slot in said blade so when said lever is manipulated manually about said pivot said second projection by virtue of said eccentricity operates to move or drive the blade relative to both guides.

Other features and advantages of the present invention will become more apparent from an examination of the succeeding specification when read in conjunction with the appended drawings, in which;

BRIEF DESCRIPTION OF THE DRAWINGS

FIG. 3 is a vertical section of FIG. 1 showing the operating lever means in the "up", protected or inoperative position;

FIG. 4 is similar to FIG. 3 and shows the razor blade in the "down", exposed or operative position;

FIG. 5 is a perspective view of the operating lever means illustrating the eccentrically disposed projections;

FIG. 6 shows an alternative embodiment of the invention; and

FIG. 7 is a vertical section in the plane of line 7—7 in FIG. 1

DESCRIPTION OF PREFERRED EMBODIMENT

Figure 1:
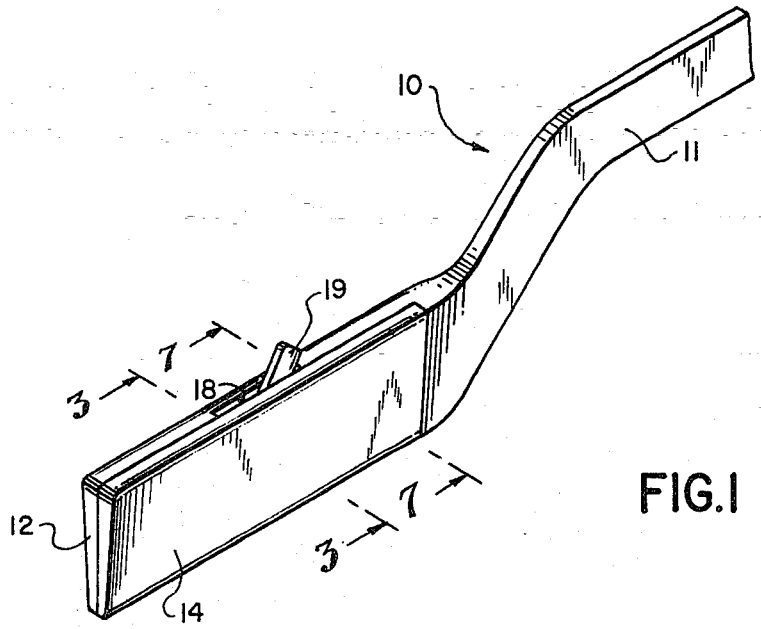
FIG. 1 is a perspective view of a straight razor embracing the principles of the present invention.

Referring now to the drawings, the reference numeral 10 indicates, generally, a barber or straight razor having a handle 11 terminating in a first blade guide 12. A second blade guide 14 is secured to the first guide 12 by sonic welding, adhesive or mechanical means.

A blade 13 is sandwiched between first blade guide 12 and second blade guide 14.

The guide 12 is formed with a pair of protuberances or bosses 16—16 received in clearance holes 17—17 formed in blade 13.

The blade guides 12 and 14 are secured together by welding sonically the bosses 16—16 to guide 14 as is most apparent in FIG. 7.

Obviously other methods or means may be used to secure the blade guides such as by adhesives, mechanical staking and the like.

The clearance holes 17—17 must be large enough, i.e., include sufficient "slop" to permit blade 13 to move upwardly and downwardly in a manner which will become more apparent as this specification proceeds.

Guide 12 is formed with a recess or cut-out 18 to provide clearance for the "throw" of a lever 19. Lever 19, formed with a stub shaft 21, is supported in guide 12 in that shaft 21 is rotatably received in bore 22 formed in guide 12.

Figure 2:
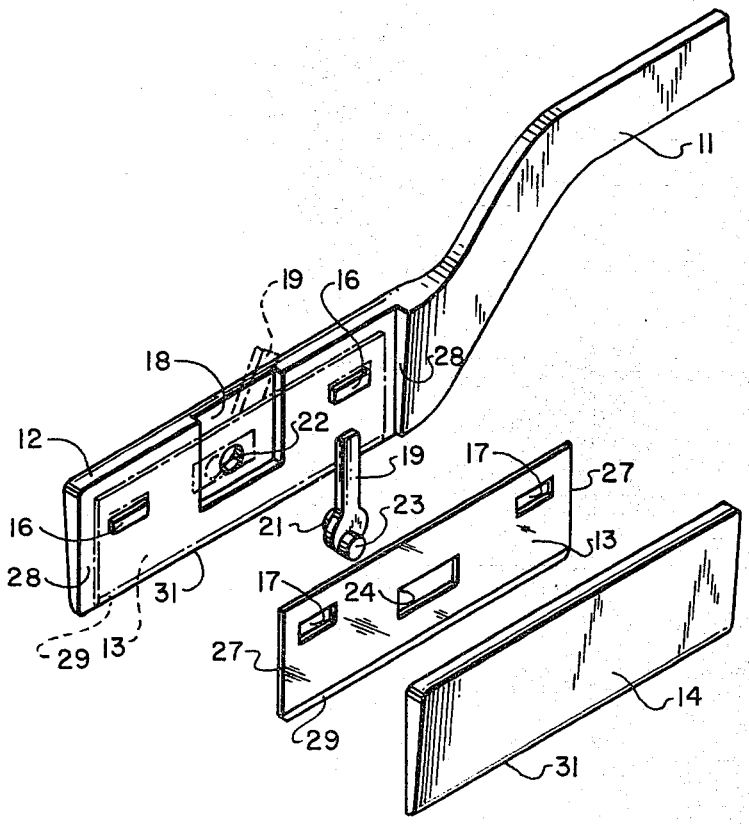
FIG. 2 is an exploded view of FIG. 1.

The lever 19 is also formed with an eccentrically mounted stub shaft 23 which engages and makes a driving connection with blade 13 through elongated blade slot 24, most clearly disclosed in FIG. 2.

The guide 14 is formed with a cut-out or recess 26 to provide clearance for the throw of eccentric stub shaft 23 when the lever 19 is manipulated in a manner which will be apparent thereinafter.

The blade 13 is movable upwardly to a position corresponding to the arrangement of FIG. 3 defining a closed condition and downwardly to the operative position of FIG. 4.

The blade 13 is "tracked" or guided in that blade end edges 27—27 are in sliding contact with mating shoulders 28—28 formed in blade guide 12 (FIGS. 2 and 6) to insure that blade cutting edge 29 maintains a parallel relationship with the bottom edges 31—31 of the blade guides 12 and 14.

In operation, the lever 19 is movable to and fro about stub shaft or pivot 21 as shown by the arc 15 in FIG. 2 to "drive" blade 13 from a first or closed position (illustrated in FIGS. 2 and 3) in which the blade is in the "up" position and the edge is shielded by guide edges 31—31 to a "down" position or operative position as illustrated in FIG. 4.

As stated previously, shoulder 28—28 track the blade edges 27—27 to keep its cutting edge 29 parallel to guide edges 31—31.

The amount of blade projection is not critical to the invention and may vary as considerations of good performance, blade construction and blade guide edge configuration require.

Furthermore, it is anticipated that the lever 19 may be of opposite hand, i.e., the stub shafts 21 and 23 reversed.

In addition, a lever of either right or left hand may be pivotally mounted in the blade guide 14 instead of guide 12.

Note also that the blade slot 24 and the recess 26 in guide 14 are both elongated to provide clearance for the horizontal component of motion that occurs as the eccentric stub shaft 23 drives the blade "up and down".

FIG. 6 shows an alternative embodiment of the invention in which the bottom edges of the blade guides are serrated or uniformly notched to provide lands 32—32 and grooves 33—33.

The lands of the first guide 35 may be in register with the lands of the second guide 40 or the guides may be shifted or phased laterally any desired portion of pitch distance P.

Note that in the FIG. 6 embodiment of the invention the blade cutting edge 45 need not project beyond below the apices of lands 32—32 to be operative because the cutting edge is exposed by the grooves 33—33.

Correspondingly, in the "up" or closed position, the blade edge 45 must be lifted above the root of the grooves 33 so that the edge is fully shielded.

Obviously a wide variety of embodiments of the present invention may be devised as engineering and mass production considerations dictate without departing from the spirit and scope of the invention.

What is claimed is:

1. A barber razor consisting essentially of a plastic handle terminating in a first blade guide, a second plastic blade guide, a blade having a cutting edge sandwiched movably between said guides, a plastic operating lever supported by said first guide and making a driving connection with said blade for moving the blade relative to the guides from a first position defining a closed position to a second position defining an operating position, said first blade guide being formed with a track for controlling motion of the blade, both said guides being serrated along edges adjacent the cutting edge of said blade, the serrations of one blade being offset relative to the serrations of the other, and said first blade guide being formed with bosses received in clearance holes in said blade, said bosses facilitating securing the blade guides together by sonic welding.

* * * * *